United States Patent [19]

Wallner

[11] Patent Number: 4,567,662

[45] Date of Patent: Feb. 4, 1986

[54] DEVICE FOR DRAWING ELLIPSES

[76] Inventor: Peter Wallner, 114 Vasey Crescent, Campbell, A.C.T. 2601, Australia

[21] Appl. No.: 627,838

[22] Filed: Jul. 5, 1984

[30] Foreign Application Priority Data

Aug. 30, 1983 [AU] Australia ..... PG1112

[51] Int. Cl.[4] ..... B43L 11/04

[52] U.S. Cl. ..... 33/30.2

[58] Field of Search ..... 33/27 R, 27 B, 27 F, 33/27 K, 30 R, 30 B, 30 C, 30 F, 30 G

[56] References Cited

U.S. PATENT DOCUMENTS

| | | | |
|---|---|---|---|
| 383,697 | 5/1888 | Bormann | 33/30 B |
| 1,825,444 | 9/1931 | Dietrich | 33/27 K |
| 2,636,272 | 4/1953 | Aukstuolis | 33/30 B |
| 4,170,824 | 10/1979 | Mikulin | 33/30 C |

FOREIGN PATENT DOCUMENTS

| | | | |
|---|---|---|---|
| 468487 | 11/1928 | Fed. Rep. of Germany | 33/30 B |
| 603712 | 10/1934 | Fed. Rep. of Germany | 33/30 C |
| 452343 | 10/1949 | Italy | 33/30 C |
| 225119 | 11/1924 | United Kingdom | 33/30 C |

*Primary Examiner*—Richard R. Stearns

[57] ABSTRACT

A compass type instrument capable of describing curves, circles and ellipses of infinitely variable angle and size. The central column of the instrument is supported on a foot that aligns the instrument with the center of the desired ellipse and maintains the instrument still and perpendicular to the surface to be marked. Removably mounted on the central column is a circular cam that is hinged symmetrically along it's diameter. Non-circular symmetrically hinged shapes may be substituted to alter the curve. The extent that this cam is folded about itself is adjustable and determines the angle of the ellipse described. An articulated follower arm is adjustably mounted to the top of the central column. About the central column rotates the upper section of the follower arm that pivots at a point variable from the center of the column. The upper follower arm is spring loaded in order to keep contact with the cam. The upper follower arm may be curved or angled outward from the central column at the area of contact with the cam to further vary the shape described. From the upper section of the follower extends an arm that lies parallel to the surface to be marked. To this lower extending arm is attached a movable telescopic scribe that is adaptable to suit a variety of common drawing instruments and can be moved along the lower extension arm thus determining the size of the shape described.

2 Claims, 2 Drawing Figures

DEVICE FOR DRAWING ELLIPSES

BACKGROUND OF THE INVENTION

This invention relates to drawing equipment capable of describing a range of ellipses, closed curves and circles. This invention is not limited to drafting and would be a valuable aid in the textile, metal and glass industries.

Prior devices such as those disclosed in U.S. Pat. Nos. 4,170,824 and 4,150,487 have been capable of describing elliptical shapes but they have not been wholly satisfactory.

This invention utilizes a novel principle which produces a greater variety of curves; can describe truer ellipses, circles and symmetrical curves; is far more simpler and more economical to manufacture; requires no particular user skill and is more adaptable to common drawing needs.

SUMMARY AND OBJECTS OF THE INVENTION

The primary objectives of the invention are to provide an instrument that can conveniently describe an infinitely variable range of ellipses, circles and other symmetrical closed curves. It is intended to improve upon the disadvantages of previous similar devices.

Another purpose is to provide an instrument of simple operation and construction that would be more economical to manufacture than prior art devices.

Another purpose is to provide an instrument that can be placed at the center of the desired ellipse, easily adjusted for size and angle and then conveniently used with common drawing instruments in frequently encountered drawing situations.

Yet another object is to provide an instrument that can describe true and accurate geometric figures.

The invention in general terms is similar to a drawing compass yet having a non-rotating, vertical central column and a revolving head on top of this column. On the column is mounted a symmetrically hinged circular cam about which is guided an articulated follower arm which pivots at the revolving head. Jointed to the lower end of the follower arm is a horizontal extension arm. To the horizontal arm is attached a movable telescopic scribe assembly. Adjustment for angle of ellipse is made by folding the hinged cam more or less acutely. Adjustment for size of the ellipse is made by moving the telescopic slide assembly along the horizontal arm.

BRIEF DESCRIPTION OF THE DRAWINGS

By way of example only one embodiment of the invention is represented in the accompanying drawings.

DESCRIPTION OF THE PREFERRED EMBODIMENT

Figure 1:
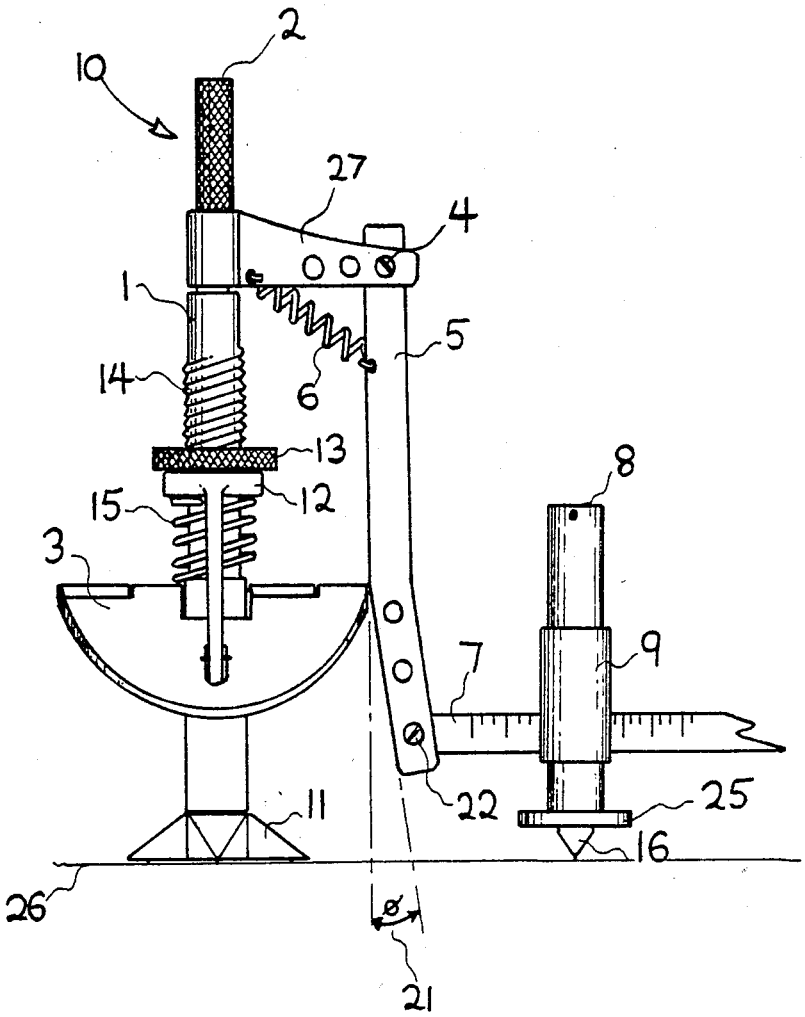
FIG. 1 is a front elevation depicting the instrument at the point of describing the outmost curve of the major axis of an ellipse.
Figure 2:
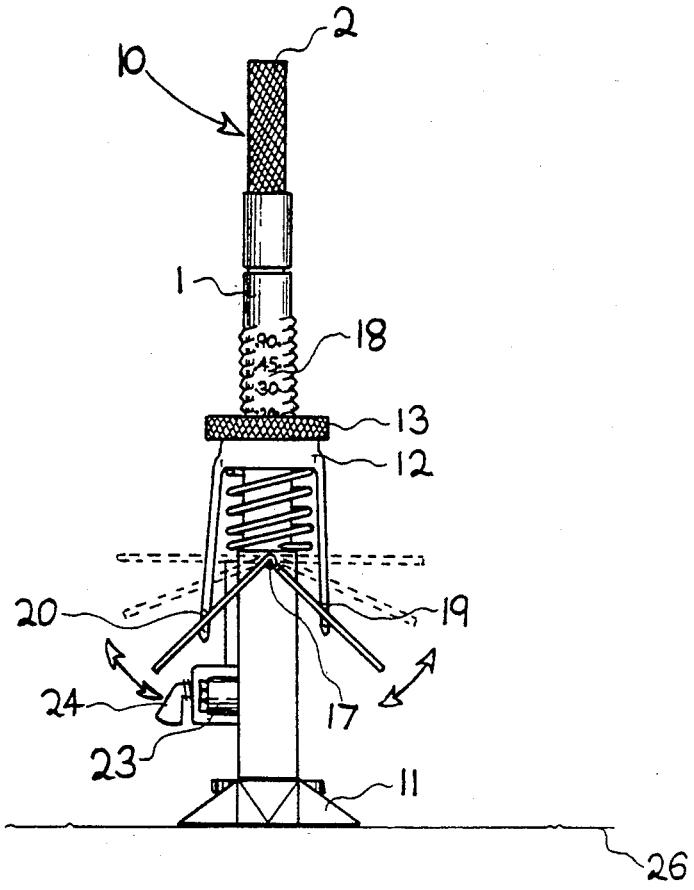
FIG. 2 is a side elevation of the instrument in the same situation as in FIG. 1.

Referring to the drawings a compass type instrument is wholly represented at 10.

A central column 1 is threaded at 14 and is placed on the surface to be marked 26 sitting on a pedestal 11 that is pointed to align the instrument with the intersection of the major and minor axis of an ellipse. The pedestal 11 is pinned or textured at the base to prevent rotation on the surface to be marked and broad enough to provide stability to maintain a vertical stand through the instruments operation. A symmetrically hinged circular disc 3 is detachably mounted to the column 1 by means of a friction fit pin 17. The disc 3 forms the variable cam that determines the angle of the ellipse described. Adjustment for the hinged cam 3 is provided by screwing a textured knob 13 about the thread 14 on the central column 1. A dual legged washer 12 is positively attached to the circular cam 3. At points 19 and 20 where the legged washer 12 is attached to the cam 3 means is provided for the cam 3 wings to pivot. An expansion spring 15 maintains tension in the angle adjustment assembly eliminating free play and returning the cam 3 to any adjustment required. The column 1 is marked at 18 to indicate the extent the cam 3 is folded and thus the consequent angle of the ellipse described. A rotating head 2 is textured to ensure easy finger operation, from the head 2 extends a horizontal member 27 to which the articulated follower arm 5 is attached by screw 4 in order to swing freely away from and towards the column 1. A retention spring 6 ensures contact is kept between the upper follower arm 5 and the cam 3. The head member 27 has provision to alter the follower arm pivot point 4 furthering curve variety.

In operation the upper follower arm 5 rotates about the cam 3 pivoting in and out in accordance with the adjustment of the cam. The follower arm may be angled or curved at the area of contact with the cam 21 to compensate mechanical limitations or further accentuate figures described. A graduated horizontal beam 7 is attached to the follower arm 5 by screw 22. The position of this connection is variable along the follower arm 5. Horizontal beam 7 is offset at 23 to ensure that scribe 16 marks surface 26 in alignment with follower arm 5 and pedestal 11 pointer. A telescopic outer slide 9 can be moved at any point along beam 7 by means of lock screw 24 thus determining the size of the figure described. The inner slide 8 contains a lockable iris capable of centrally holding various drawing styli 16. Inner slide 8 is weighted by collar 25 which ensures ample pressure is maintained on scribe 16 throughout full rotating telescoping movement. In operation pedestal 11 is placed on the surface to be marked aligning pointers with desired figure center. Cam 3 is adjusted to desired angle by means of adjusting knob 13. Follower arm 5 is moved to most extended contact point with cam 3. This point is the outer extreme of the major axis, the size of the ellipse desired is set by moving telescopic slide assembly 9 along beam 7 and locking at favored position by screw 24. Maintaining slight downward pressure the user twists rotating head 2 by a simple thumb and forefinger manipulation.

While the preceeding description defines one preferred embodiment it is envisaged further refinements, modifications and other applications may be made. Any such changes falling within the true spirit and scope of the invention should be covered in the appended claims.

What is claimed is:

1. An improved instrument for drawing circles, ellipses and closed curves including the combination of a calibrated, threaded, perpendicular column having a supporting, indicating base, a symmetrically folding circular cam mounted about a central portion of the said column, a gripable rotating head member located on top of said column, a spring loaded pivot arm moveably attached to said head member contacting said folding cam along a shaped lower end of said pivot arm, a calibrated horizontal beam moveably attached to the lower end of said pivot arm, said horizontal beam bearing a moveable telescopic scribe carrier locatable along the length of said beam, said telescopic scribe carrier containing an internal iris, said iris accepting and centrally locking various drawing instruments.

2. An instrument for drawing circles, ellipses and closed curves on a surface including the combination of a threaded, perpendicular column, a broader pedestal pointed on the surface plane on four opposing sides attached to the base of said column, said pedestal points indicating the intersection of the major-minor axis of an ellipse, said pedestal base underside being textured or bearing pins, a symmetrically hinged folding cam being centrally located about said stationery, perpendicular column, a gripable rotating head member mounted on said column, a spring loaded articulated follower arm moveably attached to said head member, a horizontal beam attached to lower end of said follower arm, a remote telescopic scribe carrier moveably mounted on said horizontal member.

* * * * *